United States Patent [19]

Thompson

[11] Patent Number: 4,869,382

[45] Date of Patent: Sep. 26, 1989

[54] SECUREMENT SYSTEM FOR TELESCOPICALLY ENGAGEABLE MEMBERS

[75] Inventor: Donald V. R. Thompson, New York, N.Y.

[73] Assignee: Newburgh Manufacturing Corporation, Newburgh, N.Y.

[21] Appl. No.: 188,892

[22] Filed: May 2, 1988

[51] Int. Cl.[4] ..... B65D 23/00; B65D 23/08

[52] U.S. Cl. ..... 215/12.1; 215/100 R; 220/8

[58] Field of Search ..... 215/12.1, 100 R; 220/69, 8; D9/371

[56] References Cited

U.S. PATENT DOCUMENTS

| | | | |
|---|---|---|---|
| D. 281,281 | 11/1985 | Matalon | D9/371 X |
| 1,073,897 | 9/1913 | Goss | 215/12.1 |
| 2,076,549 | 4/1937 | Conner | 215/12.1 X |
| 2,640,626 | 6/1953 | Newell | 220/69 X |
| 2,659,920 | 11/1953 | Bogan et al. | 215/100 R X |
| 3,871,543 | 3/1975 | Chadfield et al. | 215/12.1 |
| 3,918,920 | 11/1975 | Barber | 215/12.1 X |
| 3,942,667 | 3/1976 | Thomas | 215/12.1 |
| 4,371,087 | 2/1983 | Saujet | 215/12.1 |

FOREIGN PATENT DOCUMENTS

| | | | |
|---|---|---|---|
| 916169 | 1/1963 | United Kingdom | 215/12.1 |

*Primary Examiner*—Sue A. Weaver

*Attorney, Agent, or Firm*—Mattern, Ware, Stoltz & Fressola

[57] ABSTRACT

By providing a bottle with a plurality of sets of ribs formed about the outer surface thereof and providing a cooperating telescopically engageable decorative portion with a plurality of sets of fins extending from the inside surface thereof, a unique securement system is achieved for frictionally interengaging and securely mounting the decorative portion to the bottle portion, thereby attaining a unique desirable aesthetic effect. Preferably, each set of ribs on the bottle are arranged substantially vertically along each side edge thereof, with the plurality of sets of fins of the decorative portion being positioned for mating, overriding engagement therewith. In addition, each of said elongated fins of the decorative portion preferably extend the entire length of the zone created by the plurality of ribs in order to assure overriding, interlocking secure engagement between said ribs and said fins.

10 Claims, 1 Drawing Sheet

FIG. 1
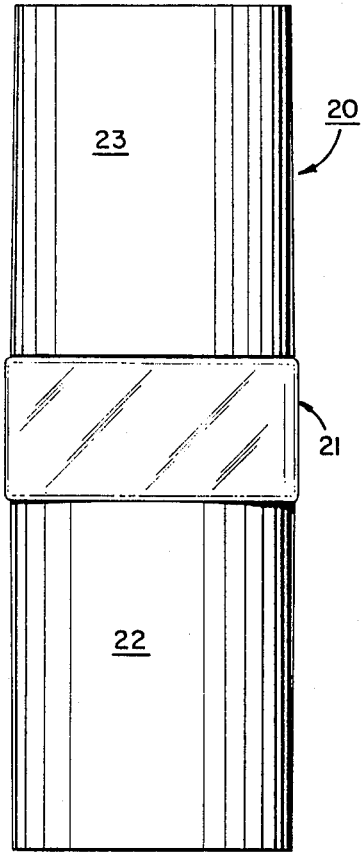
FIG. 2
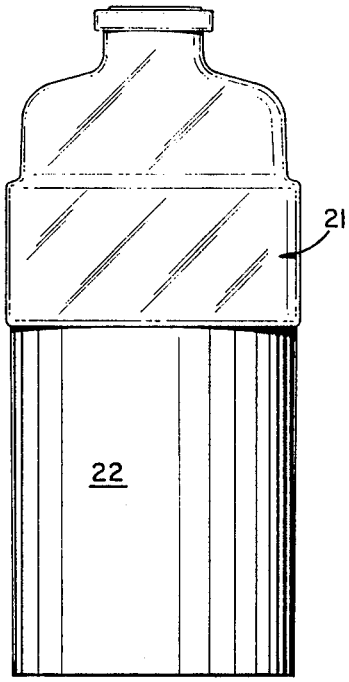
FIG. 7
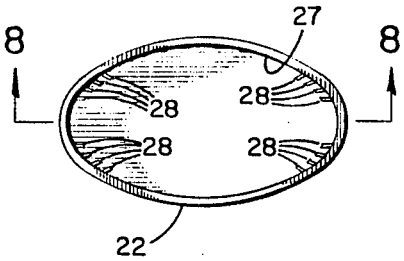
FIG. 8
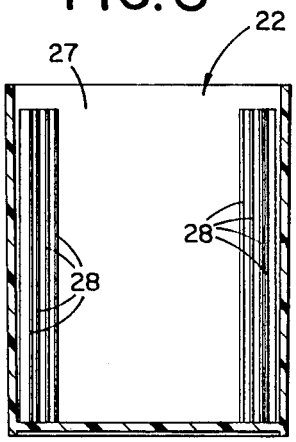
FIG. 3
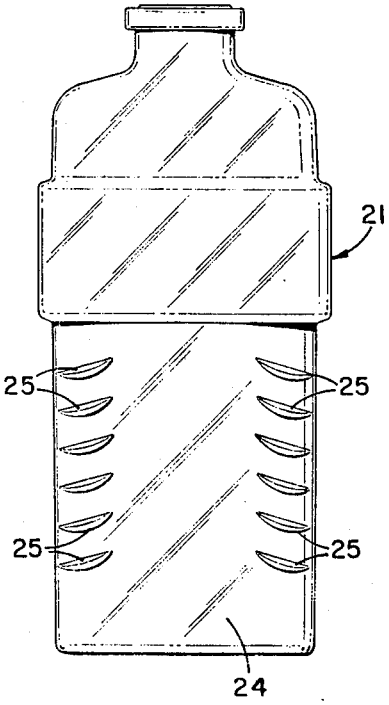
FIG. 4
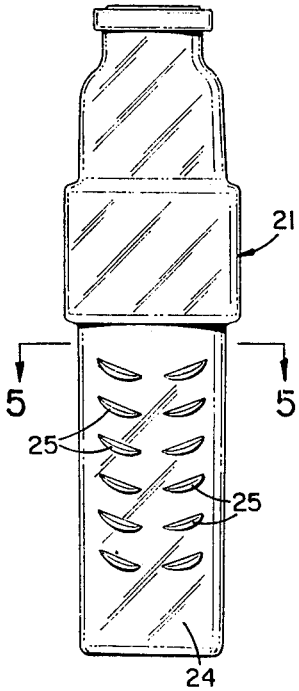
FIG. 6
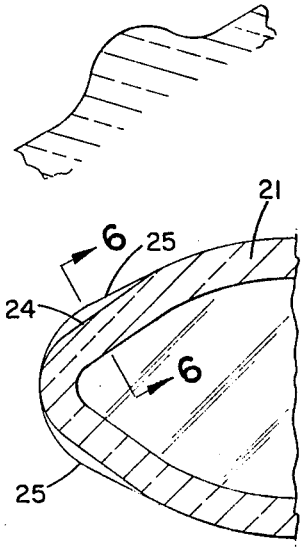
FIG. 5

SECUREMENT SYSTEM FOR TELESCOPICALLY ENGAGEABLE MEMBERS

TECHNICAL FIELD

This invention relates to securement systems for frictionally engaging interconnectable members and more particularly to securement systems for affixing a unitary decorative portion telescopically mounted about a fluid containing member.

BACKGROUND ART

Securely affixing two telescopically engaged members has long been a problem that has faced various product configurations. In particular, in the decorative bottle field, many alternate designs and constructions have evolved in order to achieve unique decorative containers.

In one desirable configuration, a fluid holding bottle or container is partially secured with a decorative member which peripherally surrounds a substantial portion of the bottle and is retained about the fluid containing bottle. However, in order to securely retain the decorative portion in the desired position, a securement system is required to provide secure frictional interengagement, without adhesives.

It has been found that adhesive interconnection systems are unreliable, since most containers are made from glass which do not provide the bonding required. As a result, secure engagement of the cooperating member with glass containers has long been a problem.

Therefore, it is a principal object of the present invention to provide a securement system for frictionally interconnecting a fluid container with a decorative portion which will remain in place during normally expected use.

Another object of the present invention is to provide a securement system having the characteristic features described above which assures secure locked frictional interengagement of the decorative portion with the fluid containing portion in a manner which assures that unwanted removal of the decorative portion will not occur.

Another object of the present invention is to provide a securement system having the characteristic features described above which securely interconnects a bottle with a decorative portion which peripherally surrounds a major portion of the bottle and is telescopically mounted thereto.

Other and more specific objects will in part be obvious and will in part appear hereinafter.

SUMMARY OF THE INVENTION

The present invention overcomes the prior art difficulties and eliminates any need for adhesive means by incorporating a plurality of sets of ribs outwardly extending from the outer surface of the fluid containing bottle, which are independently positioned peripherally about the outer surface of the bottle. In addition, the decorative portion to be mounted to the bottle and securely affixed thereto incorporates a plurality of sets of fins extending outwardly from the inner wall thereof and positioned for mating frictional interengagement with the ribs of the bottle portion. In this way, secure frictional engagement of the fins with the ribs is attained.

Furthermore, it has been found that at least four separate and independent elongated fins must be employed in each set of fins formed in the decorative portion in order to provide the desired secure frictional secure mounted engagement of the decorative portion to the bottle portion.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which:

FIG. 1 is a front elevational view of a typical decorative container employing the present invention;

FIG. 2 is a front elevational view of the decorative container of FIG. 1, with the cap removed;

FIG. 3 is a front elevational view of the bottle portion of the decorative container of the present invention, with the decorative portion removed;

FIG. 4 is a side elevational view of the bottle of FIG. 3;

FIG. 5 is a cross-sectional plan view of the bottle, partially broken away, taken along line 5—5 of FIG. 4;

FIG. 6 is a greatly enlarged cross-sectional view taken along line 6—6 of FIG. 5;

FIG. 7 is a top plan view of the decorative portion of the container of the present invention, with the bottle and cap removed; and FIG. 8 is a cross-sectional front elevational view taken along line 8—8 of FIG. 7.

DETAILED DESCRIPTION OF THE INVENTION

FIG. 1 shows one embodiment of the type of decorative fluid containers which is achievable by employing the securement system of the present invention. In this embodiment, decorative container 20 comprises a fluid containing bottle 21, a decorative portion 22, and a bottle cap 23. As is apparent from FIG. 1, by incorporating the securement system of the present invention, one unique decorative container that can be attained comprises a lower decorative portion 22 which is visually identical in appearance to the cap portion 23. In this way, a uniquely balanced and aesthetically pleasing configuration is realized.

In FIG. 2, fluid containing bottle portion 21 and telescopically engaged decorative portion 22 are shown with cap 23 removed. In this embodiment telescopically engaged decorative portion 22 must be securely affixed to bottle portion 21 in order to allow the consumer to hold decorative portion 2 and bottle 21 and repeatedly remove cap 23 therefrom in order to access the contents of bottle portion 21.

As is apparent, without being securely affixed to bottle 21, decorative portion 22 could become dislodged after repeated use. Furthermore, in order to allow bottle portion 21 to be made from glass, the preferred composition from which bottle 21 is manufactured, the use of adhesive means or glue has been found to be unacceptable to secure decorative portion 22 to bottle portion 21.

It has been found that the secure interlocking engagement of decorative portion 22 with bottle portion 21 is achieved by forming bottle portion 21 with a plurality of sets of outwardly extending or raised ribs 25, each each set of ribs being disposed about the body. By referring to FIGS. 3 and 4, the plurality of the sets of raised ribs 25 can best be seen.

In the preferred embodiment, four sets of raised ribs 25 are disposed about the outer peripheral surface 24 of bottle 21 on the portion of the bottle which is telescopically engaged with decorative portion 22. As shown in FIGS. 3 and 4, the set of raised ribs 25 are preferably arranged substantially vertically along the edges of surface 24 of bottle 21, with each rib being slanted relative to the central axis of bottle 21. It has been found that this arrangement provides optimum stability and interlocking interengagement of bottle 21 with decorative portion 22.

Furthermore, although the number of ribs 25 incorporated into each of the sets positioned on bottle 21 can be altered without departing from the scope of this invention, it has been found that six ribs positioned substantially adjacent and parallel to each other represents the preferred rib construction for each of the four sets of ribs. In this way, optimum secure locked interengagement of bottle 21 with decorative portion 22 is assured.

As shown in FIGS. 7 and 8, decorative portion 22 incorporates a plurality of elongated fins 28 extending outwardly from inner wall 27 thereof. In the preferred embodiment, decorative portion 22 incorporates four independent sets of elongated fins 28 positioned on inner surface 27 for mating contacting and interlocking engagement with upstanding ribs 25 of bottle 21. As a result, each set of elongated fins 28 is positioned for overriding engagement with each of the sets of ribs 25 of bottle 21.

It has also been found that at least four independent ribs 28 must be employed in each set of ribs formed in decorative portion 22. Although more than four ribs may be employed, it has been found that fewer than four separate independent ribs does not provide the requisite secure locked engagement of decorative portion 22 with bottle 21.

In the preferred embodiment, fins 28 extend from inner surface 27 of decorative portion 22 at varying relative angles to each other and with a length which will cause fins 28 to be deformed as decorative portion 22 is telescopically mounted to bottle portion 21. In this way, the plurality of fins 28 in each of the four sets thereof is forced to deform as fins 28 slidingly override upstanding ribs 25 of bottle 21. This cause fins 28 to become securely lockingly interengaged with ribs 25, and provides the desired secure locked engagement between decorative portion 22 and bottle portion 21.

As is clearly shown in FIGS. 5 and 6, each rib 25 extends outwardly from outer surface 24 of bottle 21. By providing the plurality of sets of ribs 25 along both the front and rear surfaces of bottle 21, an envelope is provided which establishes a substantially greater outer peripheral dimension for outer surface 24 of bottle 21.

In this way, decorative portion 22 can be easily telescopically mounted about surface 24 of bottle 21 and frictionally interengaged therewith to assure the secure mounted interconnection of decorative portion 22 with bottle 21. In the preferred embodiment, each rib 25 extends from surface 24 by between about 0.025 to 0.050 inches. In this way, frictional, secure engagement of ribs 25 with fins 28 is assured.

It Will thus be seen that the objects set forth above, among those made apparent from the preceding description, are efficiently attained and, since certain changes may be made in the above product without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A securement system for frictionally engaging a first member peripherally about a second, fluid containing member, said system comprising:

A. a plurality of sets of ribs
  a. comprising a plurality of ribs in each of said sets,
  b. each rib of each set extending outwardly from a first surface of the second member in spaced substantially parallel aligned relationship with the other ribs of the set, and
  c. each of said set of ribs being spaced about the first surface of the second member in substantially parallel, non-coplanar alignment with each other; and B. a plurality of sets of elongated fins
  a. extending from a first surface of the first member and positioned for mating, overriding, engagement with the ribs of said second member, and
  b. each of said sets of fins comprising at least four separate and independent fins grouped together with each fin of each set arranged for frictional overriding locking engagement with all of the ribs of one set of ribs of said first member thereby assuring secure frictional retained engagement of the first members with the second member when telescopically interengaged.

2. The securement system defined in claim 1, wherein said plurality of sets of ribs of said second matter are further defined as comprising four sets, with each of said sets comprising at least six independent ribs.

3. A securement system for frictionally engaging a first member peripherally about a second, fluid containing member, said system comprising:

A. a plurality of sets of ribs
  a. comprising a plurality of ribs in each of said sets,
  b. each rib of each set extending outwardly from a first surface of a second member in spaced, substantially parallel aligned relationship to the adjacent rib, and
  c. each of said ribs positioned at an acute angle to the central axis of said second member; and B. a plurality of sets of elongated fins
  a. extending from a first surface of the first member and positioned for mating, overriding, engagement with the ribs of said second member, and
  b. each of said sets of fins comparing at least four separate and independent fins grouped together for frictional overriding locking engagement with one set of ribs of said first member thereby assuring secure frictional retained engagement of the first members with the second member when telescopically interengaged.

4. The securement system defined in claim 3, wherein said second, fluid containing member comprises a glass bottle and said plurality of sets of ribs extend outwardly from the outer surface of said bottle.

5. The securement system defined in claim 4, wherein said first member comprises a decorative member constructed for peripherally surrounding and decoratively enhancing the bottle and being securely lockingly engaged with the bottle when telescopically mounted thereto, preventing unwanted dislodgement therefrom.

6. The securement system defined in claim 4, wherein each of said ribs is further defined as extending outwardly from the bottle surface a distance between about 0.025 and 0.050 inches.

7. The securement system d fined claim 5, wherein each of said fins of said decorative member are further defined as comprising substantially continuous, elongated fins comprising a length sufficient to overlie and lockingly engage all of the ribs of the set thereof in which said fin is positioned to cooperatingly interengage.

8. A securement system for frictionally engaging a first member peripherally about a second, fluid containing member, said system comprising:

A. a plurality of sets of ribs extending outwardly from a first surface of the second member, and B. a plurality of sets of elongated fins a. extending from a first surface of the first member and positioned for mating, overriding engagement with the ribs of the second member, and b. each of said sets of fins comprising at least four separate and independent fins grouped together and extending outwardly from the first surface of said first member at various angular relationship thereto for frictional overriding locking engagement with one set of ribs of said first member, thereby assuring secure, frictional retained engagement of the first member with the second member when telescopically interengaged therewith.

9. The securement system defined in claim 4, wherein each of said ribs of each of said sets is arranged substantially parallel to the adjacent rib.

10. The securement system defined in claim 8, wherein the length of each of said ribs comprises a length sufficient to assure overriding locking engagement with the ribs cooperating therewith.

* * * * *